United States Patent [19]

Vanecek et al.

[11] Patent Number: 4,459,430

[45] Date of Patent: Jul. 10, 1984

[54] HIGH VOLTAGE VARIABLE DIAMETER INSULATOR

[75] Inventors: David L. Vanecek, Martinez; Chester D. Pike, Pinole, both of Calif.

[73] Assignee: The United States of America as represented by the United States Department of Energy, Washington, D.C.

[21] Appl. No.: 397,736

[22] Filed: Jul. 13, 1982

[51] Int. Cl.[3] ..... H01B 17/26; H01B 17/42

[52] U.S. Cl. ..... 174/142; 174/212

[58] Field of Search ..... 174/9 R, 11 BH, 31 R, 174/142, 212, 18, 151, 152 R

[56] References Cited

U.S. PATENT DOCUMENTS

| | | | |
|---|---|---|---|
| 1,350,925 | 8/1920 | Faccioli | 174/142 |
| 1,901,667 | 3/1933 | Rah | 174/11 BH |
| 2,082,474 | 6/1937 | Van de Graaff | 174/9 R |
| 2,251,534 | 8/1941 | Usselman | 174/142 |
| 3,189,715 | 6/1965 | Jennings | 174/142 X |
| 3,806,625 | 4/1974 | Long | 174/142 X |

FOREIGN PATENT DOCUMENTS

| | | | |
|---|---|---|---|
| 299943 | 8/1917 | Fed. Rep. of Germany | 174/31 R |
| 54-111696 | 9/1979 | Japan | 174/142 |

*Primary Examiner*—Laramie E. Askin

*Attorney, Agent, or Firm*—Clifton E. Clouse, Jr.; Roger S. Gaither; Michael F. Esposito

[57] ABSTRACT

A high voltage feedthrough assembly (10) having a tubular insulator (15) extending between the ground plane ring (16) and the high voltage ring (30). The insulator (15) is made of Pyrex and decreases in diameter from the ground plane ring (16) to the high voltage ring (30), producing equipotential lines almost perpendicular to the wall (27) of the insulator (15) to optimize the voltage-holding capability of the feedthrough assembly (10).

3 Claims, 1 Drawing Figure

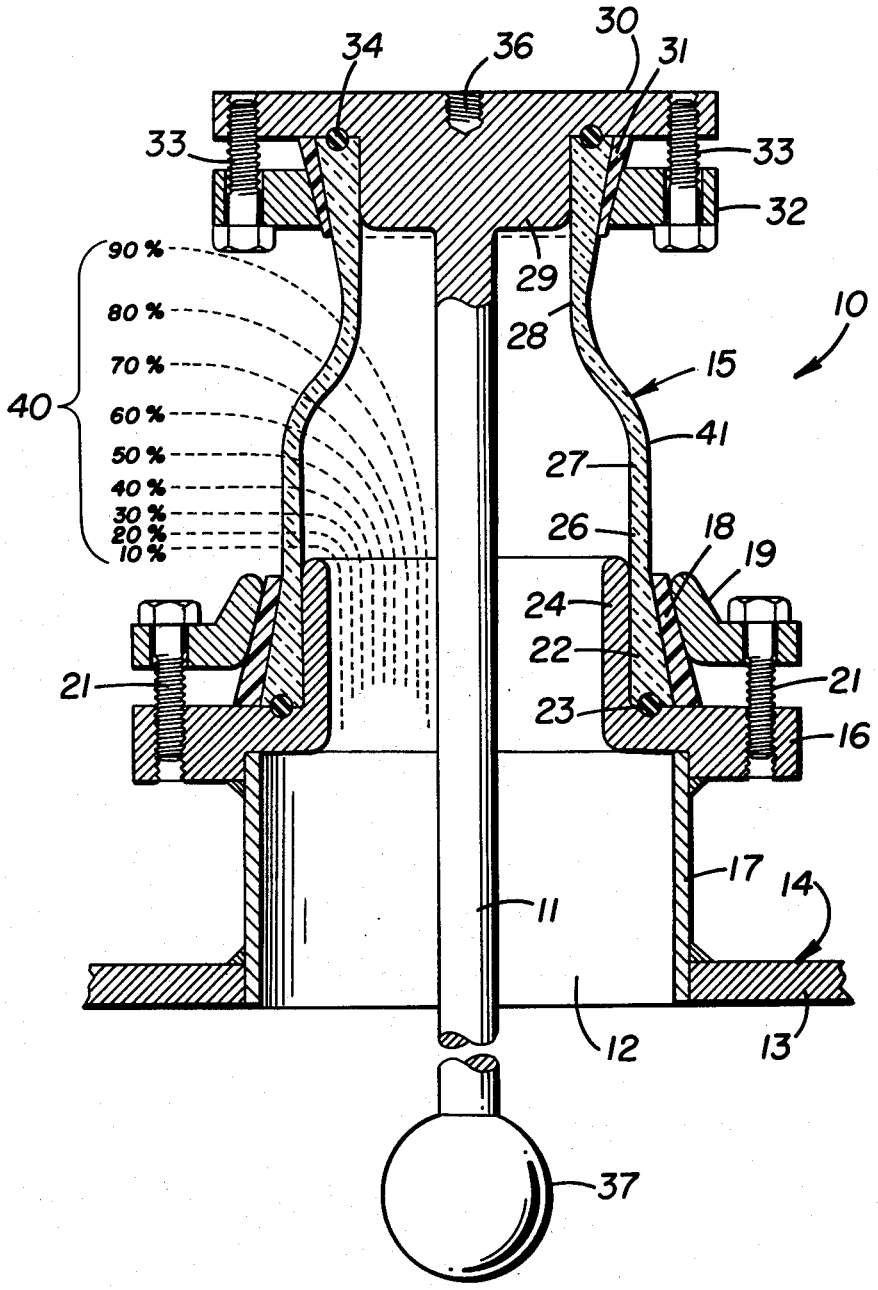
34
36
30
31
33
33
32
90 %
80 %
70 %
60 %
50 %
40 %
30 %
20 %
10 %
40
29
28
10
15
41
27
26
18
19
24
22
21
21
23
16
17
14
11
12
13
37

HIGH VOLTAGE VARIABLE DIAMETER INSULATOR

The United States Government has rights in this invention pursuant to Contract No. W-7405-ENG-48 (now No. DE-AC03-765F00098) between the U.S. Department of Energy and the University of California.

BACKGROUND OF THE INVENTION

The present invention relates generally to high voltage feedthrough assemblies and more particularly to an insulator for use in such assemblies.

Feedthrough assemblies are used to conduct high voltages into the interior of enclosed and grounded chambers. For example, such assemblies can be used to connect a high voltage (50 kilovolts or more) to an electrostatic quadrupole focusing unit in a fusion energy accelerating system.

Typically, such an assembly uses a conductor rod which extends from outside a grounded housing through an opening in the housing, the conductor rod having a terminal outside of the housing to which a source of high voltage may be connected. An insulator extends between the conductor and the housing to support the conductor rod in spaced relation to the housing opening, to seal the interior of the housing from the exterior thereof and to provide an electrical insulation capable of withstanding breakdown under the stresses of the high voltage electric field created between the conductor and housing.

Commercial high voltage insulators are generally made of ceramic material, such as zircon or steatite, and are designed to withstand a high voltage along their external surfaces. The design considerations for a feedthrough insulator are quite different, because the voltage gradient is from the center rod or conductor through the insulator to the insulator support, the latter being usually at ground potential.

Hollow, cylindrical ceramic insulators have been tested and found unsuitable for high voltage feedthrough. In particular, it has been found that field emission from the center rod results in a spark breakdown through the ceramic to the metal support, burning a hole through the insulator and causing pitting of the rod.

SUMMARY OF THE INVENTION

It is an object of the invention to provide a high voltage feedthrough assembly having a tubular insulator to interface from air to vacuum or from one insulating medium to another and which will withstand high voltage applied thereto without breakdown.

It is a further object of the invention to provide a high voltage feedthrough assembly with an insulator having a relatively low dielectric constant.

A further object of the invention is to provide a high voltage feedthrough assembly with a transparent insulator to enable visual inspection of the interior of the insulator.

Additional objects, advantages and novel features of the invention will be set forth in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, a high voltage feedthrough assembly is provided, the assembly having co-axial high and low voltage rings, an axial conductor rod connected to the high voltage ring and extending through the low voltage ring, and a co-axial tubular insulator extending between the high and low voltage rings, the insulator being characterized in having a decreasing diameter from the low voltage ring towards the high voltage ring.

It is also preferred that the insulator be made of transparent glass.

The decreasing diameter and the dielectric constant of the insulator produce equipotential lines perpendicular, or at a steep angle, to the insulator wall, thus tending to optimize the voltage-handling capability of the insulator.

BRIEF DESCRIPTION OF THE DRAWING

The accompanying drawing, which is incorporated in and forms a part of the specification, illustrates an embodiment of the present invention and, together with the description, serves to explain the principles of the invention.

The single FIGURE of the drawing is a cross sectional view through a high voltage feedthrough assembly constructed in accordance with the invention.

DETAILED DESCRIPTION OF THE INVENTION

Referring now to the drawing, which illustrates a preferred embodiment of the invention, the high voltage feedthrough assembly 10 provides a conductor rod 11 which extends through an opening 12 in the wall 13 of a vacuum enclosure 14, and an elongated tubular insulator 15.

A ground plane ring 16 is mounted on the vacuum enclosure 14 by sleeve 17. In addition to providing a mechanical support, sleeve 17 electrically connects ring 16 to wall 13 which is typically at ground potential.

Insulator 15 seats on ground plane ring 16 and is held in place thereon by a tapered split ring 18 and compression collar 19. As is apparent, tightening of bolts 21 will exert a downward force on the tapered lower end 22 of the insulator 15 so that O-ring 23 makes an air tight seal between the insulator and ground plane ring.

Ground plane ring 16 preferably has an integral electrically-conductive annular flange 24 which extends coaxially of and along the inner surface 26 of the insulator wall 27 to shield the lower tapered part of the insulator from the electric field existing between conductor 11 and the ground plane ring 16 and thus prevent the field distortion that would otherwise be caused by the tapered lower end of the insulator and the presence of the O-ring 23.

The upper end 28 of insulator 15 fits onto hub 29 of the high voltage ring 30, and is clamped to the ring by split ring 31, compression collar 32 and bolts 33. An O-ring 34 provides an air-tight seal between insulator 15 and high voltage ring 30.

With the feedthrough assembly 10 thus constructed, insulator 15 supports the high voltage ring 30 and conductor rod 11 so that the conductor rod 11, opening 12, insulator 15, ground plane ring 16 and high voltage ring 30 are all coaxial. In use, a suitable source of high voltage will be connected to tapped bore 36 of the high voltage ring 30, to place rod 11 and its terminating sphere 37 at a high potential.

Insulator 15 is preferably made of Pyrex or similar heat-resistant glass, and has a substantially uniform wall thickness throughout its unshielded length. Importantly, the diameter of the insulator decreases from the low-voltage ground plane ring 16 towards the high voltage ring 30.

A feedthrough assembly 10 has been tested using a Pyrex insulator having a shape as shown in the drawing, and with upper and lower internal diameters of two and three inches, respectively. The spaced-apart distance of the ground plane ring 16 and high voltage ring 30 was three inches.

As part of the testing, resistance paper was used to obtain a plot of the equipotential lines existing when a high voltage source was applied to high voltage ring 30. The plot is shown on the figure here as the dashed lines 40.

As is apparent, the equipotential lines are quite uniformly spaced where they pass through the insulator 15 and are at a steep angle to the inner and outer surfaces 26 and 41 of the insulator. Since the electric field lines are orthogonal to the equipotential lines, this means that the electric field lines closely follow the shape of the wall of the insulator with a minimum of cutting of the field lines from one medium to another. As a consequence, there is minimal stress from localized field enhancement which occurs at the interface of two media that differ greatly in dielectric constant.

The shape of the insulator is also advantageous in that the lengths of the insulator surfaces 26 and 41 from the high voltage ring 30 to the ground ring 16 are greater than if the insulator were cylindrical with a constant diameter. As a consequence, a longer creepage path is provided along the insulator surfaces, increasing the ability of the insulator to hold high voltages.

The use of glass in the present insulator is also advantageous in that the volume resistivity of glass is lower than that of steatite. As a consequence, an undesirable build-up of local charges will be minimized since the charges can drain off more easily.

In the testing referred to above, the insulator was tested at 50 kilovolts with complete success, and also at 100 kilovolts with only a very few failures. An increase in diameter and length of the insulator would enable it to withstand higher voltages.

The shape of the insulator is also advantageous in that it enables the overall length of the insulator and the internal pocket formed thereby to be minimized so that it is easier for a vacuum pump to maintain a vacuum inside the enclosure 14. Additionally, the bell shape of the insulator provides a greater mechanical strength to the insulator as compared to a cylindrical shape.

The use of Pyrex, or similar glass, is also advantageous in instances where the insulator is to interface from air or vacuum to insulating oil. The dielectric constant of Pyrex is relatively low, in the range of 4.0 to 6.0, enabling it to match more readily with the dielectric constant of insulating oils. This is important in the designing of high voltage insulators because the degree of dielectric field enhancement that occurs at the interface of two materials is a function of the degree of difference in the dielectric constants of the two materials.

A further advantage of using Pyrex or glass is that it enables visual inspection through the insulator to determine if there is corona or sparking, without the need for additional inspection ports.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the insulator may have a straight tapered wall. The embodiment was chosen and described in order to best explain the principles of the invention and its practical application to thereby enable others in the art to best utilize the invention in various embodiments and with various modifications as are suited to the particular use contemplated. It is intended that the scope of the invention be defined by the claims appended hereto.

We claim:

1. A high voltage feedthrough assembly having co-axial high and low voltage rings spaced axially apart, an axially-disposed electrically-conductive rod connected to the high voltage ring and extending through the low voltage ring and a co-axial tubular insulator connected to and extending between said high and low voltage rings, the improvement comprising that:

said low voltage ring has an electrically-conductive annular flange extending co-axially along the inner surface of said tubular insulator from its connection with said low voltage ring towards said high voltage ring, and said insulator has a wall of substantially uniform thickness throughout its length from said annular flange to said high voltage ring, and the diameter of said insulator decreases from said annular flange of said low voltage ring towards said high voltage ring so that the equipotential lines are almost perpendicular to the wall of said insulator.

2. A high voltage feedthrough assembly as in claim 1 wherein said insulator is made of transparent glass.

3. A high voltage feedthrough assembly as in claim 1 wherein said insulator is made of heat-resistant glass having a dielectric constant between 4.0 and 6.0.

* * * * *